US005113629A

United States Patent [19]

Carrick

[11] Patent Number: 5,113,629

[45] Date of Patent: May 19, 1992

[54] GLASS PANE REMOVAL PREVENTION DEVICE

[76] Inventor: Arthur W. Carrick, 6300 Stevenson Ave., Alexandria, Va. 22304

[21] Appl. No.: 735,802

[22] Filed: Jul. 25, 1991

[51] Int. Cl.[5] ..... E06B 1/04

[52] U.S. Cl. ..... 52/207; 292/DIG. 46

[58] Field of Search ..... 52/207; 292/DIG. 46

[56] References Cited

U.S. PATENT DOCUMENTS 3,807,779 4/1974 Enders ..... 292/DIG. 46
4,475,313 10/1984 Governale ..... 292/DIG. 46
4,514,996 5/1985 Sjogren ..... 292/DIG. 46

*Primary Examiner*—David A. Scherbel
*Assistant Examiner*—Creighton Smith
*Attorney, Agent, or Firm*—Richard C. Litman

[57] ABSTRACT

A device for preventing the removal of the glass pane of the non-slideable door or panel of a standard sliding glass assembly is disclosed. An elongated bent cylindrical member is adapted to be mounted on the non-slideable door frame on both the top and bottom of the exposed inner, vertical frame member in a non-removable fashion. This obstructs access to the frame screws. A bore is provided through the sill and into the surrounding material in such a way to receive the leg of the elongated cylindrical member. The leg tip is inserted in the bore hole and secured to the stationary door in a tamperproof manner such that any attempt to remove the panel frame screws would be obstructed by the cylindrical member.

8 Claims, 2 Drawing Sheets

GLASS PANE REMOVAL PREVENTION DEVICE

FIELD OF THE INVENTION

The present invention relates generally to the field of securing devices for sliding doors. More specifically the invention relates to the securing of the stationary panel of a sliding panel assembly against removal.

BACKGROUND OF THE INVENTION

It is commonplace for a building structure to have a sliding glass door assembly insofar as such an assembly allows ease of access, interior lighting and comfortable viewing of the outside. However, one of the major drawbacks of such an assembly is that they are difficult to secure.

Recently, the removal of the stationary door glass pane from the frame has become a commonplace tactic for home intruder specialists. By use of ordinary hand tools, one can remove the manufacturers screws from the stationary panel frame. The glass pane is then slid out from the remaining frame. This leaves the dwelling open to unlimited unauthorized access. In view of this development novel security measures must be devised for home protection.

DESCRIPTION OF THE PRIOR ART

Devices which provide security for sliding glass door assemblies are common and known in the art.

U.S. Pat. No. 1,371,111 issued to Phillips discloses a burglar proof locking device that incorporates a locking bar which at its lower end is provided with a hook to extend through an opening in the floor. This device provides a simple, strong system using a retractable bolt and auxiliary catches which will resist any spreading of the door and jamb and resists action of a prying instrument. This device may be applied to any kind of door and is constructed to resist opening and tampering.

U.S. Pat. No. 3,811,302 issued to Sorenson discloses a lock for sliding doors which is easily installed to reduce the chances of entry and may be used in a variety of different places and positions on a sliding door assembly. This device includes a housing in which is mounted a vertically movable plunger that is pushed by hand to move the plunger so that the locking end extends into a hole in the frame below the lock. The plunger is slide mounted in a vertical passageway extending through the housing.

None of the above inventions and patents, taken either singly or in combination, is seen to suggest the instant invention as claimed.

SUMMARY OF THE INVENTION

By the present invention an improved device for preventing the removal of a stationary door in a sliding glass door assembly is presented. This device is mounted on the stationary door at both the top and bottom of the door frame. With this device along with other known security devices (such as a Charlie bar) the sliding glass door assembly can be maintained in a secure fashion. This device prevents the removal of the stationary door by obstructing the glass frame screws which does not permit access by hand tools. An elongated pin member affixed to the inside vertical door frame extends into a bore within the casing sill member. It is secured firmly by concrete. In this way the panel frame screws are protected and secured in such a way that they cannot be removed.

The device is to be used in a dual panel assembly for enclosing an opening in a building wall where the panels are adapted for horizontal sliding. A peripheral channel is formed which acts as both a guide and as a support of the sliding and non-sliding panel. This channel surrounds the perimeter of the opening, and the panels fit within it, loose enough for the sliding panel to traverse horizontally, usually on rollers, in the case of larger panels such as doors. A vertical leg or pin is attached to the non-sliding panel upper and lower ends, the leg extending well beyond the confines of the perimeter. A bore hole is provided through the channel and into the surrounding material. The leg is inserted into the bore hole and secured firmly to the non-sliding panel proximate the upper and lower end of the non-sliding panel. Concrete is used in the bore hole to secure the pin and to prevent its removal.

The device is installed into the existing door frame by tamper proof screws which cannot be taken off.

In this way, the stationary door frame cannot be tampered with and the panel becomes secure. This permanently fixes the stationary door in the sill.

Accordingly, one object of the present invention is to provide an easy to install device to prevent the glass pane in the stationary door of a sliding glass door assembly from being removed.

Another object of the invention is to provide such a device which cannot be tampered with once installed.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
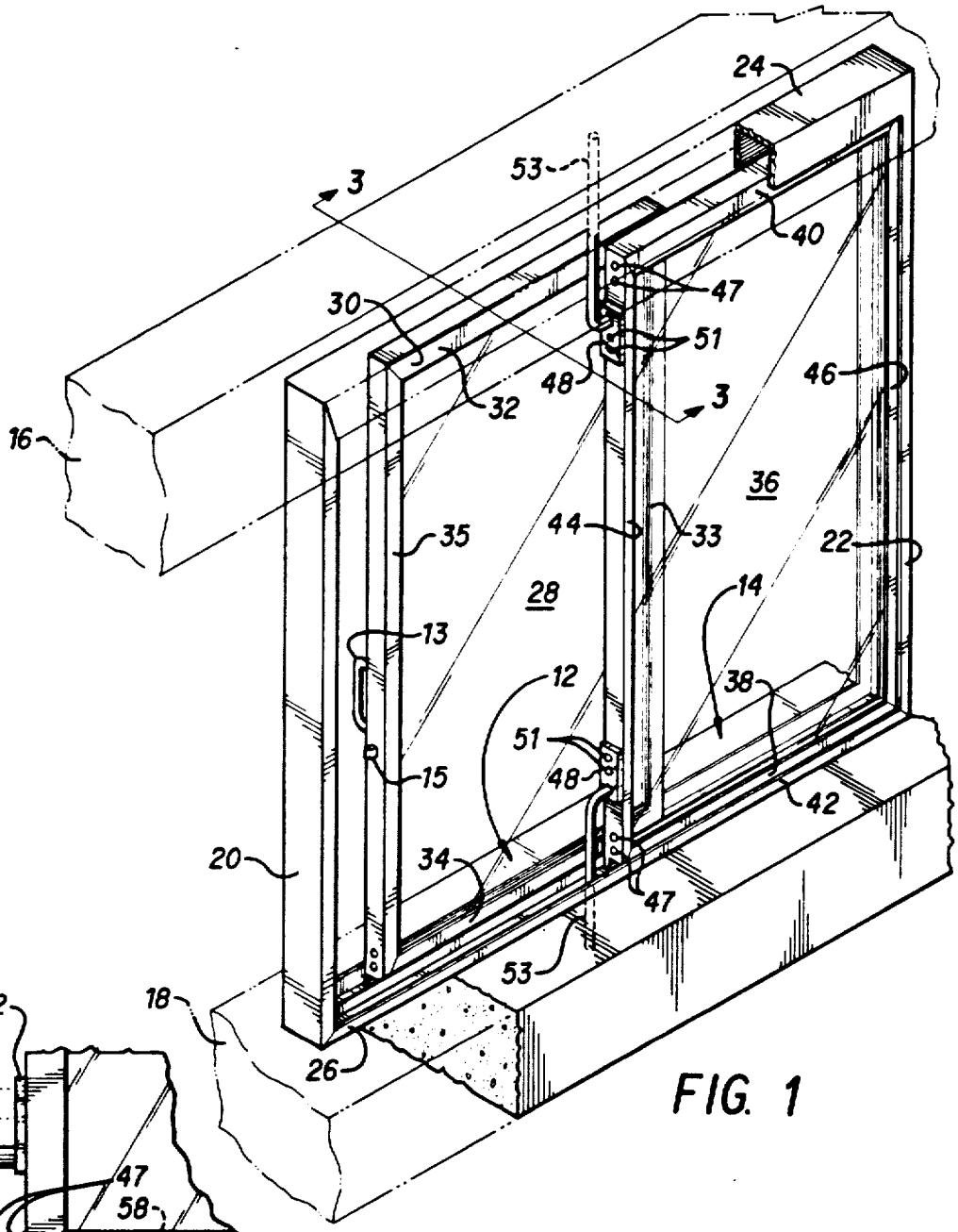
FIG. 1 is perspective of the sliding glass assembly.

Referring now to the drawings and particularly to FIG. 1 there is illustrated in general a sliding glass door assembly 10 with a sliding panel 12 and a non-sliding panel 14. A top sill 16 and a bottom sill 18 are provided and bound the assembly, which is contained within a first side channel 20, a second side channel 22, a top guide channel 24, and a bottom support channel 26. The sliding panel 12 is composed of a glass 28 and a sliding panel frame 30. The sliding panel frame 30 has a top portion 32, a bottom portion 34, a right portion 33 and a left portion 35. The sliding panel is provided with a handle 13 mounted suitably on the left portion of the sliding panel frame. The sliding panel is also provided with a latch 15 which will secure this panel, in a closed position to the first side channel 20. The non-sliding panel 14 is composed of a glass 36 and a non-sliding panel frame 38. The non-sliding panel frame 38 has a top portion 40, a bottom portion 42, a right portion 46, and a left portion 44. Two manufacturers screws 47 are located at the top and bottom of the left frame portion 44. These screws 47 secure the glass pane 36 in the non-sliding panel frame 38. If these screws are removed, the left frame portion 44 could be removed thus allowing the glass pane 36 to be slid out of the remaining frame.

The non-sliding panel frame 38 is held together by manufacturers screws 47 located on the left portion of the frame 44 on both the top and bottom of this frame portion. These are the fastening screws which when removed permit the glass pane 36 to be removed.

The non-sliding panel 14 is provided with upper and lower panel generally designated securing members 48. A bore hole 49 is provided through the top and bottom sills as well as the top guide channel 24 and the bottom support channel 26. These bore holes are centered in the middle of the aforementioned U-shaped channel members. One end of each panel securing member 48 is provided with a flange or mounting plate 52 to allow attachment to the non-sliding panel inner frame 44. The attachment is made proximate the upper and lower ends of the non-sliding panel frame left portion 44 in such a fashion to allow the offset legs 53 of the securing members to mate within the bore holes 49 provided. Concrete 60 is placed in these bore holes to make the mating permanent. In this fashion the manufacturers screw 47 are obstructed fully which does not permit them to be removed.

Figure 2:
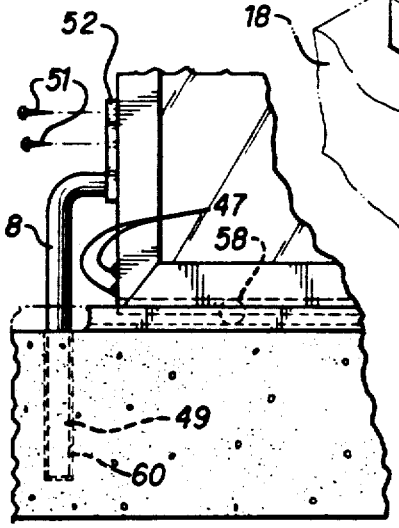
FIG. 2 is a fragmentary elevation of the lower corner of the non-sliding panels of FIG. 1.

Referring now to FIG. 2, the lower left portion of the non-sliding panel 38 is shown in relation to the securing member 48. Two tamperproof securing screws 51 are illustrated prior to their insertion through the flange 52. The bore hole 49 is shown with the securing member leg portion 51 in generally mating arrangement. A guide roller 58 are shown which are typically employed to facilitate sliding of the panels.

Figure 3:
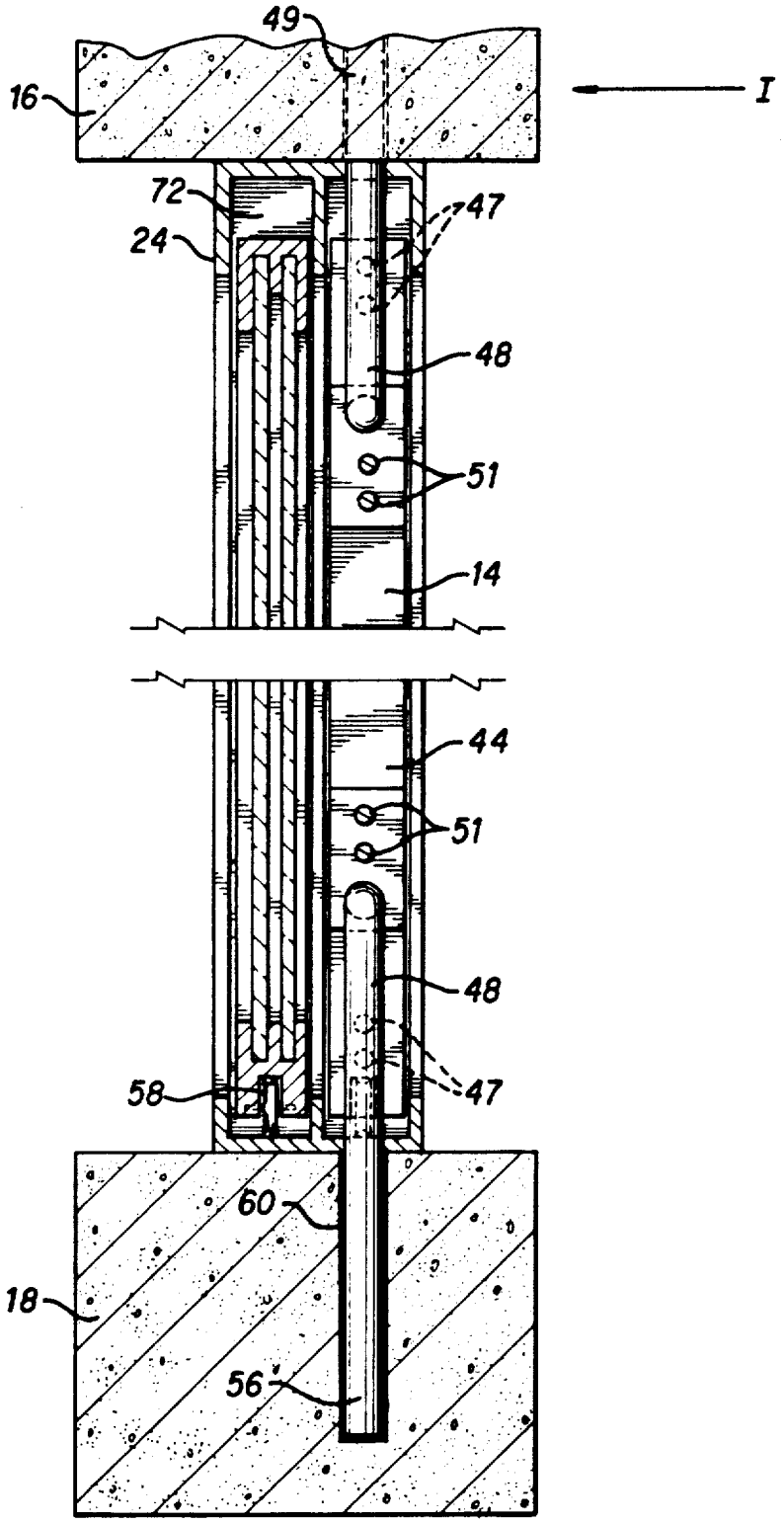
FIG. 3 is a vertical sectional view taken along the line 3—3 of FIG. 1.

A cross-sectional view of the apparatus 48 disposed on a sliding glass door assembly is shown in FIG. 3. Tamperproof screws 51 are secured to the non-sliding panel frame left portion 44 via flange 52. In this way the cylindrical leg portion 53 fully obstructs the brand screws 47. There is a panel clearance 72 provided in the top guide channel 24. This is required to permit installation into the guide and support channels. The leg portion 56 of the apparatus 48 is secured in the bore 49 by concrete which does not allow vertical motion of the stationary panel.

It is to be understood that the present invention is not limited to the sole embodiment described above, but encompasses any and all embodiments within the scope of the following claims.

I claim:

1. In a dual panel assembly for enclosing an opening bounded by top and bottom sills in a building wall wherein one of a pair of panels is normally adapted for rectilinear horizontal sliding displacement and the other is normally fixed in place, the improvement comprising, a peripheral channel defining an inwardly facing cavity within said opening and including first and second side channels, a top guide channel and a bottom support channel, said top guide channel and bottom support channel respectively secured relative said top and bottom sills, said pair of panels comprising sliding and fixed panels each including a frame having inner and outer frame portions and top and bottom frame portions, said second panel inner frame portion having top and bottom edges, said frame portions are secured together by panel frame securing means, said panels disposed within said opening with said top and bottom frame portions respectively contained within said cavity of said top guide channel and bottom support channel with said sliding panel normally slideably displaceable between said first and second side channels, fixation means secured to said fixed panel inner frame portion by tamperproof means and including a vertically disposed leg having an end tip projecting beyond an edge of said inner frame portion of said fixed panel, one said sill provided with a vertical bore to closely receive and permanently secure said fixation means leg, said fixed panel having a height intermediate the distance between said top and bottom sills and the distance between said top guide channel and bottom support channel, and said fixation means located as to obstruct access to said panel frame securing means, whereby said panel frame securing means are obstructed so as to preclude their removal.

2. A panel assembly as claimed in claim 1 wherein, said sliding panel outer frame portion is provided with a panel handle.

3. A panel assembly as claimed in claim 2, including a latch mechanism between said sliding panel outer frame portion and said first side channel whereby said sliding panel is securable to said first channel to prevent normal sliding movement.

4. A panel assembly as claimed in claim 1 wherein, said fixation means is disposed adjacent said fixed panel bottom frame portion.

5. A panel assembly as claimed in claim 1 wherein, said fixation means is disposed adjacent both said fixed panel top and bottom frame portions.

6. A panel assembly as claimed in claim 1 wherein, said tamperproof means includes screws.

7. A panel assembly as claimed in claim 6 wherein said panel frame securing means are screws.

8. A panel assembly as claimed in claim 7 where said fixation means leg is secured in said bore by concrete.

* * * * *